US008043105B2

(12) United States Patent
Schmidt et al.

(10) Patent No.: US 8,043,105 B2
(45) Date of Patent: Oct. 25, 2011

(54) SEALABLE SQUIB CONNECTOR SYSTEM

(75) Inventors: Thomas Schmidt, Nuremberg (DE); Takehiko Osuga, Kanagawa (JP)

(73) Assignee: FCI Automotive Holding, Guyancourt (FR)

( * ) Notice: Subject to any disclaimer, the term of this patent is extended or adjusted under 35 U.S.C. 154(b) by 0 days.

(21) Appl. No.: 12/451,020

(22) PCT Filed: Apr. 23, 2007

(86) PCT No.: PCT/IB2007/052683

§ 371 (c)(1), (2), (4) Date: Jan. 29, 2010

(87) PCT Pub. No.: WO2008/129366

PCT Pub. Date: Oct. 30, 2008

(65) Prior Publication Data

US 2010/0173510 A1 Jul. 8, 2010

(51) Int. Cl.
*H01R 13/52* (2006.01)

(52) U.S. Cl. ..... 439/271

(58) Field of Classification Search ..... 439/271–277
See application file for complete search history.

(56) References Cited

U.S. PATENT DOCUMENTS

| | | | | |
|---|---|---|---|---|
| 4,707,047 | A | 11/1987 | Michaels et al. | 439/271 |
| 6,290,537 | B1 * | 9/2001 | Sommer | 439/559 |
| 2005/0009390 | A1 | 1/2005 | Barker et al. | 439/188 |

FOREIGN PATENT DOCUMENTS

| | | | |
|---|---|---|---|
| GB | 2 297 202 | A | 7/1996 |
| WO | WO 2006/131140 | A1 | 12/2006 |

* cited by examiner

*Primary Examiner* — Ross Gushi
(74) *Attorney, Agent, or Firm* — Harrington & Smith

(57) ABSTRACT

The invention relates to sealable squib connectors, in particular for airbag ignition systems. The connector including a connector housing with a plug-in projection, which plug-in projection has a mating face at its distal end; a seal expansion element; and a resilient sealing ring provided at the mating face of the plug-in projection between the mating face and the seal expansion element. The seal expansion element is being movable against the mating direction towards the mating face from an open position to a closed position thereby expanding the sealing ring.

12 Claims, 6 Drawing Sheets

SEALABLE SQUIB CONNECTOR SYSTEM

1. FIELD OF THE INVENTION

The invention relates to scalable squib connectors, in particular for use in SRS (Safety Restraint System) systems.

2. BACKGROUND OF THE INVENTION

The squib connectors according to the prior art are commonly formed of injection molded plastic parts and usually consist of a plug connector and a corresponding female counter connector. In many applications it is necessary to protect the electrical connection between a connector and its counter connector against moisture and/or dust. This is in particular true for electrical connections having important safety functions, like for example the electrical connections between a squib connector and the counter connector of an airbag ignition system. The sealing of the connection respectively of these two connectors parts has to be reliable on the one hand and should on the other hand not impair the assembly of the two connectors.

Sealable squib connectors according to the prior art consist for example of a plug connector and a corresponding connector receptacle. The seal, like for example a sealing ring, is arranged around the top rim of the connector receptacle, such that when the plug-connector is inserted into the receptacle the sealing element is firmly compressed between the upper rim of the receptacle and a correspondingly shaped sealing surface provided on the plug-connector. However, this arrangement has several disadvantages. For one, the scaling ring is very often exposed to the environment and therefore subjected to mechanical, chemical or physical stresses, like for example exposure to light and UV-radiation. Further, the sealing acts against the plug-in direction of the connectors thereby increasing the necessary insertion force. Further, such a sealing arrangement produces a biasing force in coupled condition which acts to urge the plug connector out of the receptacle of the counter connector. This biasing force of the seal can lead over time to a weakening of the mechanical connection of plug and counter connector ultimately leading to an unsatisfactory sealing effect.

As a result, there exists a need in the art for an improved scalable squib connector, which offers a reliable sealing action which at the same time does not or barely affect the connecting process. It is therefore an object of the present invention to provide a sealable connector, in particular for airbag ignition systems, which reduces or minimizes at least one of the above described problems and/or disadvantages.

3. SUMMARY OF THE INVENTION

According to the invention a sealable squib connector or a sealable squib connector system is provided, in particular for airbag ignition systems for example of passenger vehicles, which comprises a connector housing comprising a plug-in projection, which plug-in projection has a mating face at its distal end. In other words, in its broadest sense the invention relates to a plug connector device. The connector further comprises a seal expansion element and a resilient sealing ring, which ring is provided at the mating face of the plug-in projection such that it is arranged between the mating face and the seal expansion element. Preferably, the mating face has a corresponding sealing surface onto which the sealing ring is pressed in the fully mated condition of the connector with its counter connector. The seal expansion element is being movable against the mating direction towards the mating face from a first or open position to a second or closed position thereby expanding the sealing ring. Due to this expansion of the sealing ring it is possible to increase the outer diameter of the ring and to establish a reliable seal against moisture and/or dust when the squib connector is mounted in a corresponding connector receptacle. By means of the movable seal expansion element the seal is thus only established after the insertion of the plug-in projection into the receptacle is almost or fully completed. As a result, the sealing does not impair the insertion process.

Preferably, the sealing ring is arranged around the seal expansion element. In other words, a portion of the seal expansion element respectively the seal expansion element itself protrudes through the opening defined by the sealing ring. In one embodiment the seal expansion element comprises a portion having a diameter larger than the inner diameter of the unexpanded sealing ring. This portion is positioned outside the interior of the sealing ring in the first position of the seal expansion element. In this position of the seal expansion element the sealing ring is preferably not or only very slightly expanded by the expansion element. In the second position of the expansion element the larger portion is arranged in the interior of the sealing ring, thereby expanding the sealing ring.

In one aspect, the seal expansion element comprises an essentially cylindrical portion having a diameter larger than the inner diameter of the unexpanded sealing ring, which cylindrical portion is positioned outside the interior of the sealing ring in the first position of the expansion element and which portion is arranged in the interior of the sealing ring in the second position, thereby expanding this sealing ring.

In a further embodiment the seal expansion element has a portion in the shape of a truncated cone. This portion can be part of an essentially cylindrical portion. The smallest diameter of the truncated cone is smaller than the inner diameter of the sealing ring and the largest diameter of the truncated cone is larger than the inner diameter. In this way, the sealing ring can be expanded by means of the slanted surface of the cone when the expansion element and the mating face are moved towards each other.

It should be noted, that in certain aspects it makes no difference for the invention, whether the seal expansion element is moved towards the plug-in projection or whether the plug-in projection is moved towards the seal expansion element as long as a relative movement between expansion element and plug-in projection, respectively the mating face, takes place. In one aspect of the invention the seal expansion element is moveably mounted on the plug-in projection, such that it can be moved along the axis of mating direction.

4. BRIEF DESCRIPTION OF THE PREFERRED EMBODIMENTS

The present invention is illustrated by way of example and not limitatively in the accompanying figures like reference numerals indicate similar elements and in which.

Figure 2:
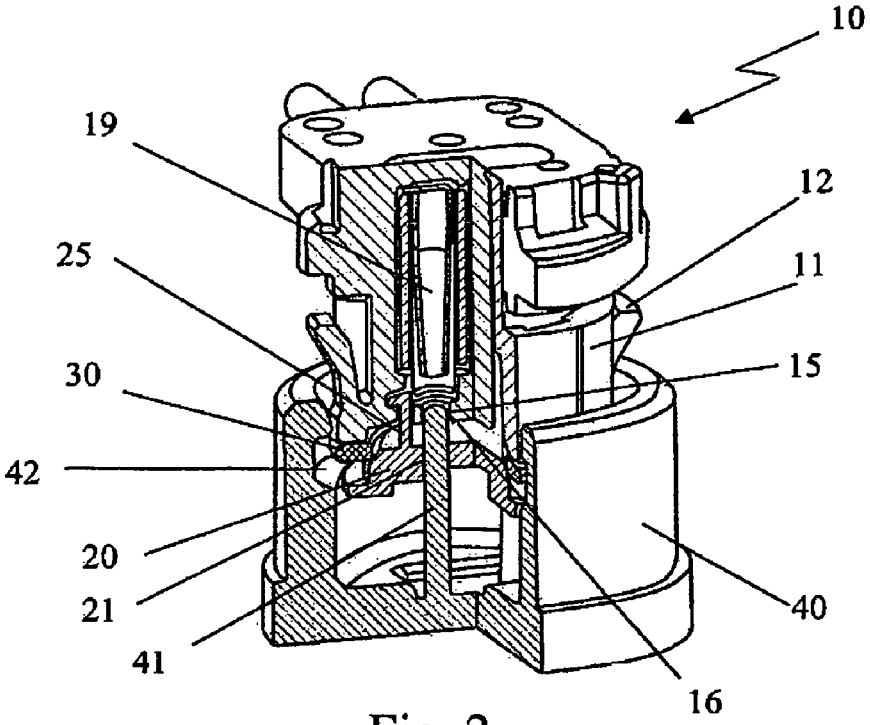
FIG. 2 is a partially cut view of the connector of FIG. 1 showing the connector in a pre-assembled condition with a plug receptacle.
Figure 3:
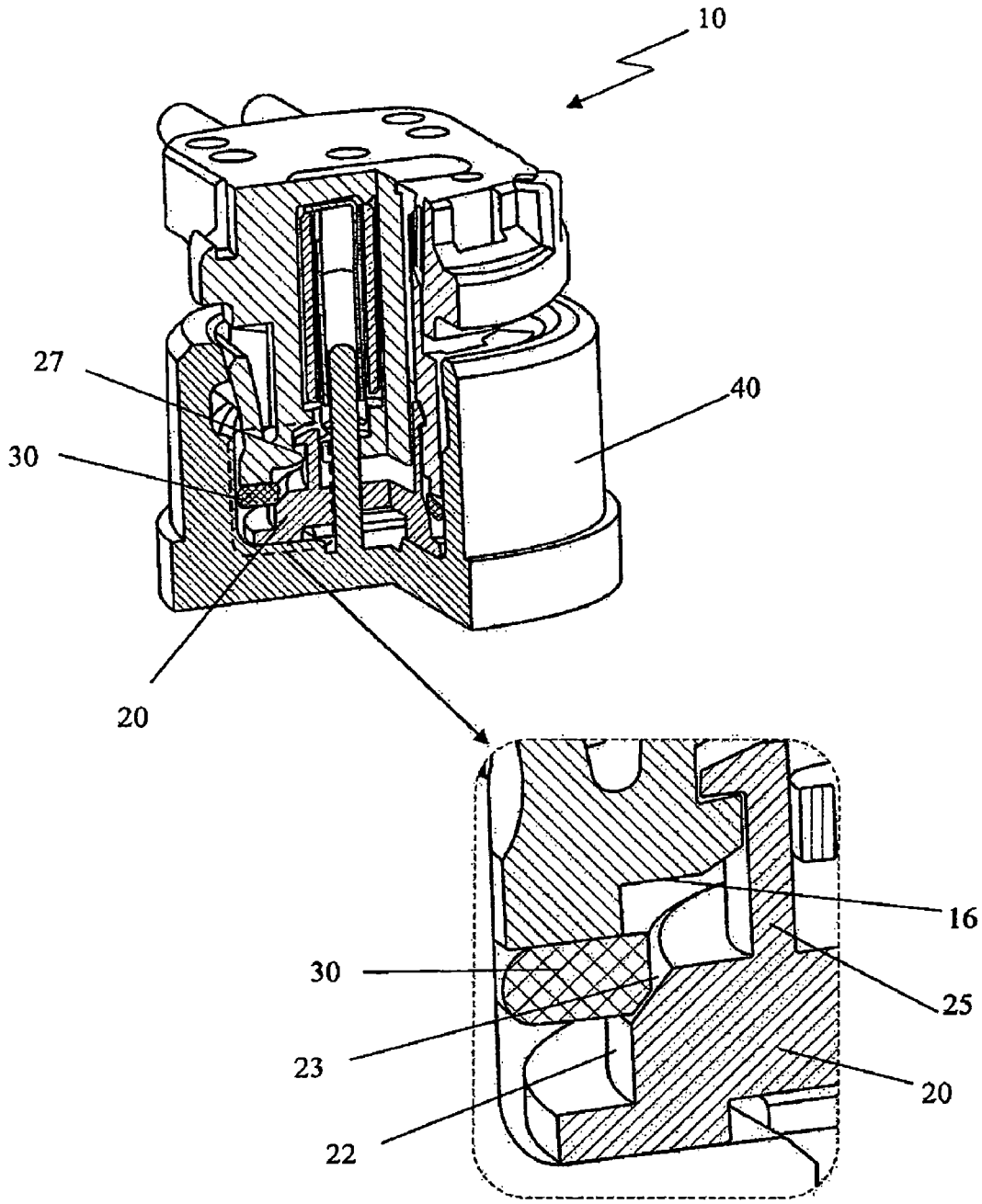
Figure 4:
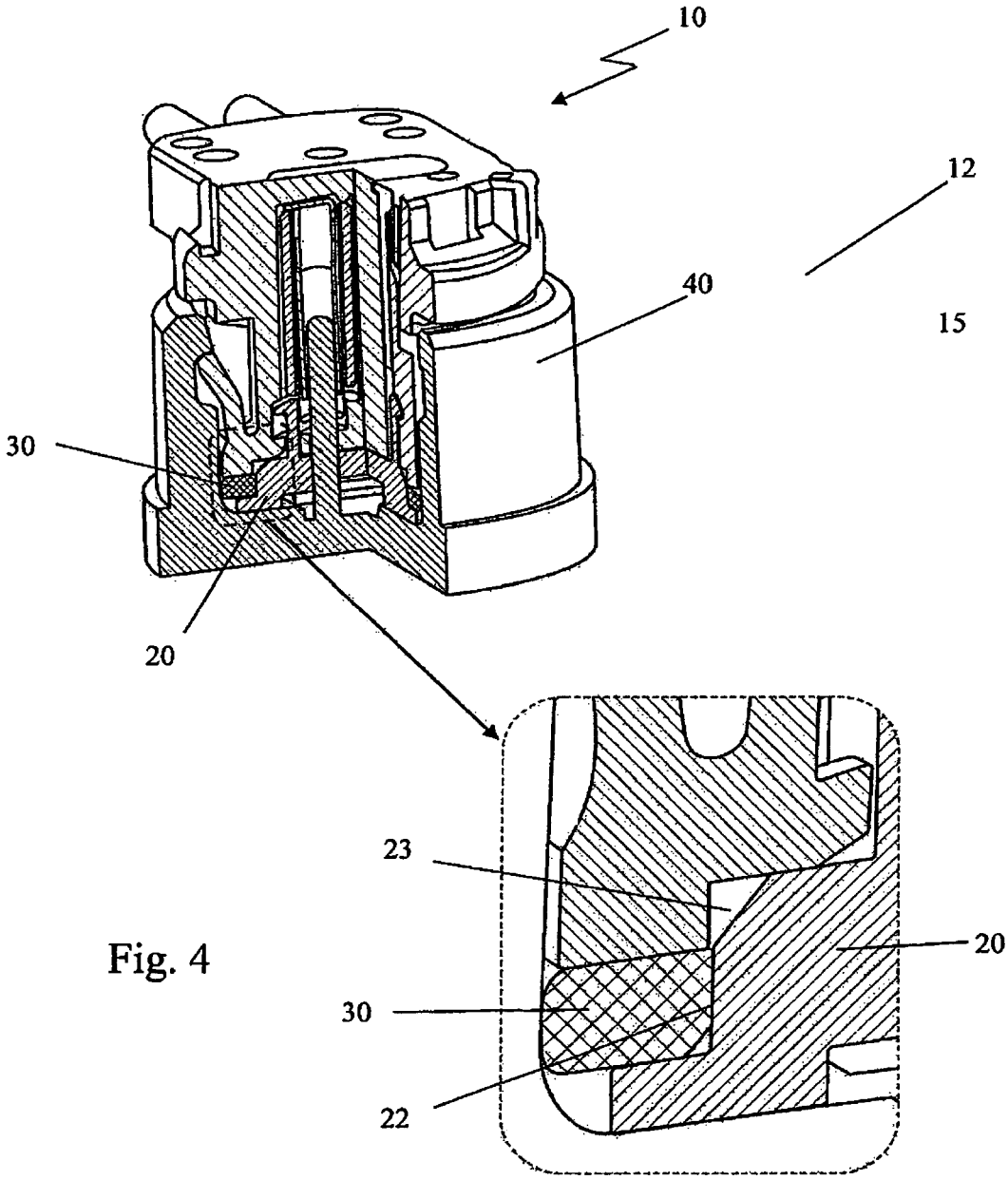
Figure 4:
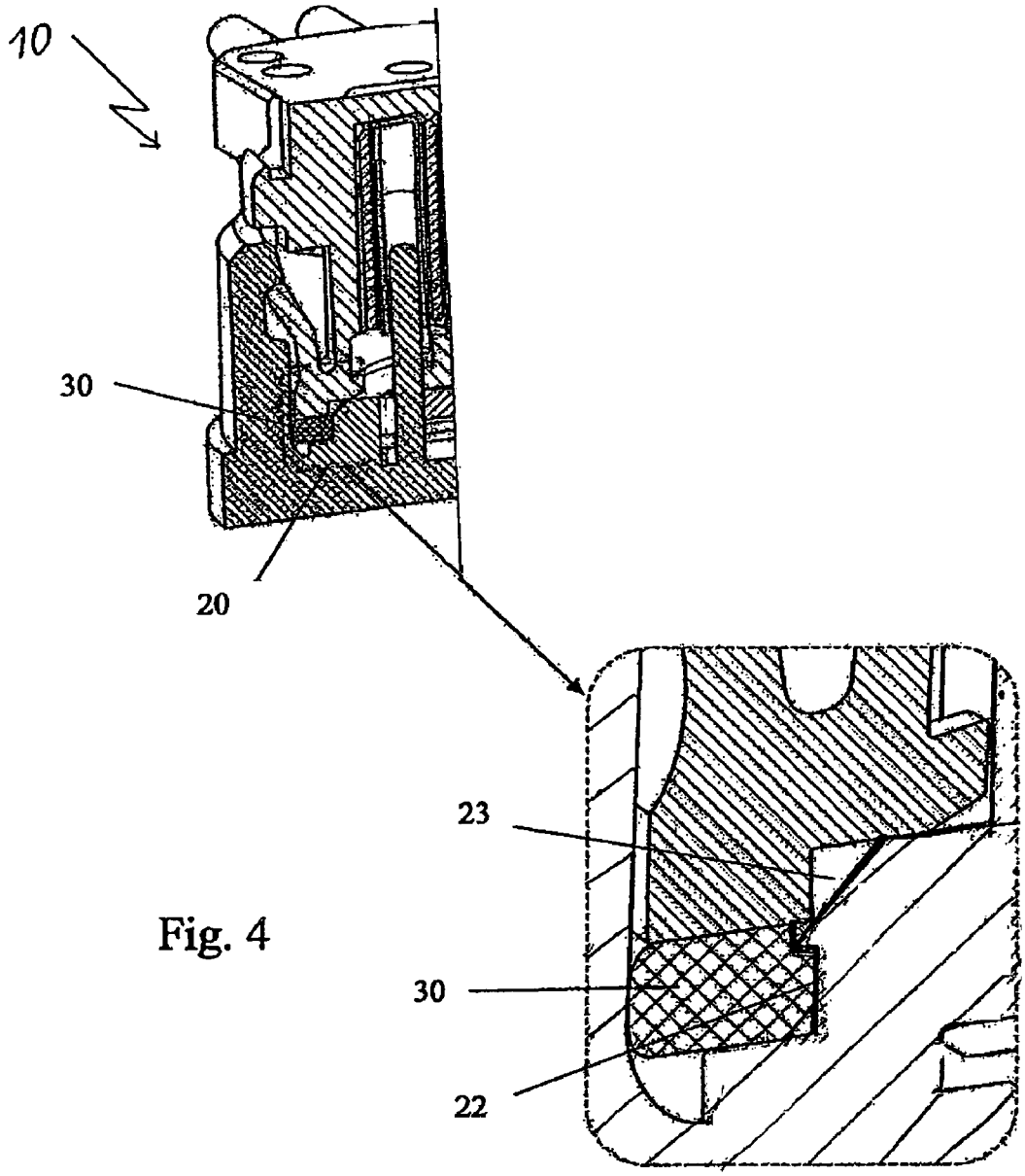
Figure 5:
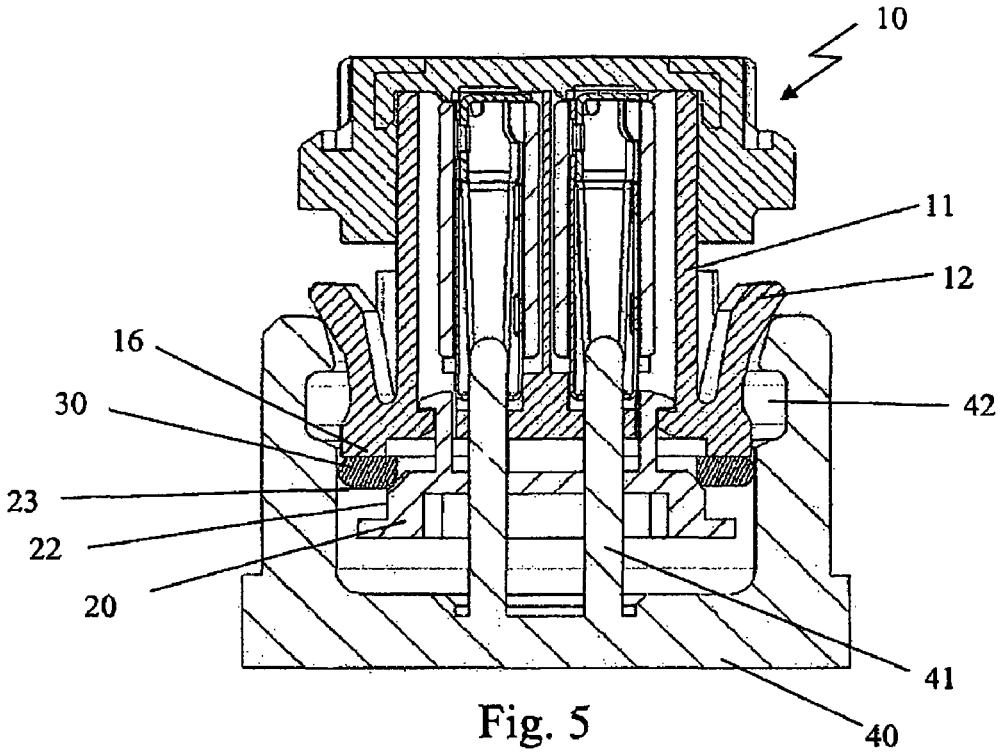
Figure 6:
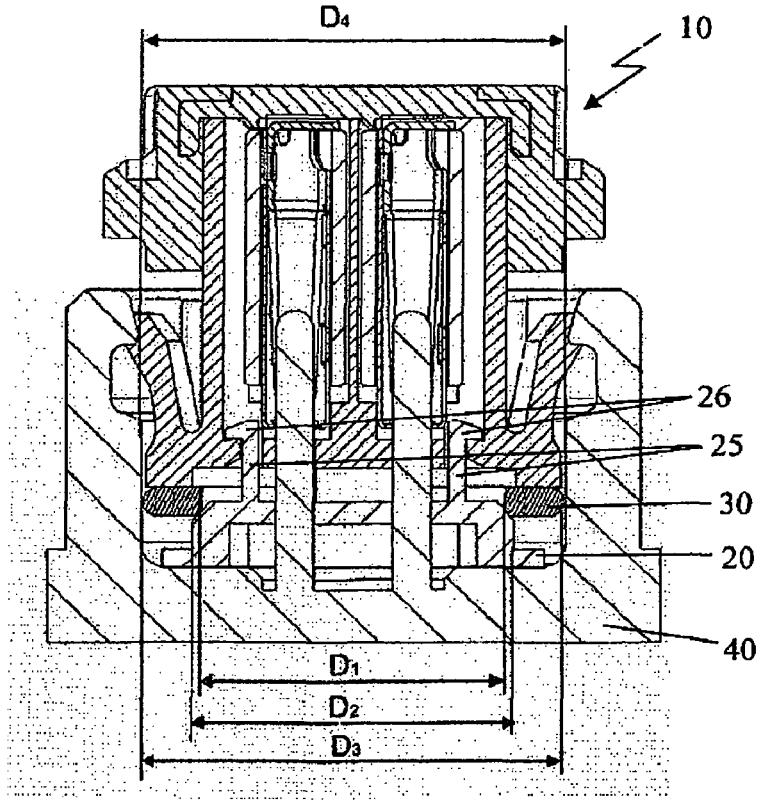
Figure 7:
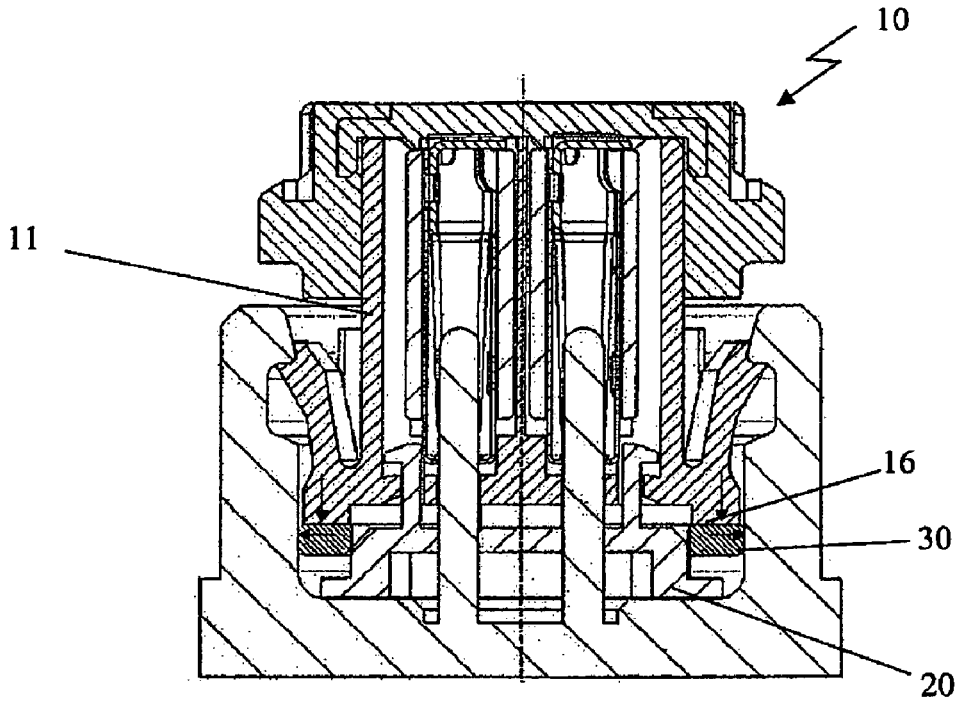
Figure 8:
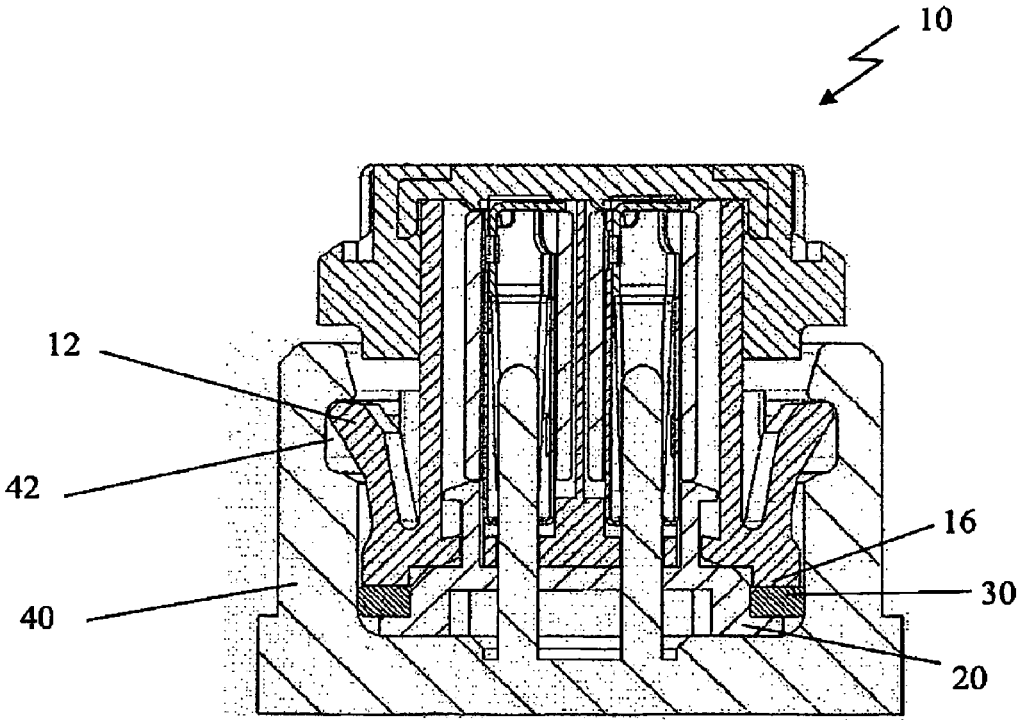

FIG. 3 corresponds to FIG. 2 and shows the connector shortly before it is fully locked with its counter connector together with an enlarged view of a detail of the connector;

FIG. 4 is a partially cut three-dimensional view showing the connector in its fully mated condition together with an enlarged view of a detail of the connector; FIG. 4' is a partially cut three-dimensional view showing an alternative solution of this connector in its fully mated condition together with an enlarged view of a detail of the connector;

FIG. 5 shows a lateral cross-section of a connector according to the invention as it is being inserted into a counter connector;

FIG. 6 corresponds to the view of FIG. 5 with the connector somewhat more inserted into its counter connector;

FIG. 7 corresponds to FIGS. 5 and 6 showing a pre-locked condition of the connector; and FIG. 8 shows a cross-sectional view of the connector in its fully locked condition.

5. DESCRIPTION OF THE PREFERRED EMBODIMENTS

Figure 1:
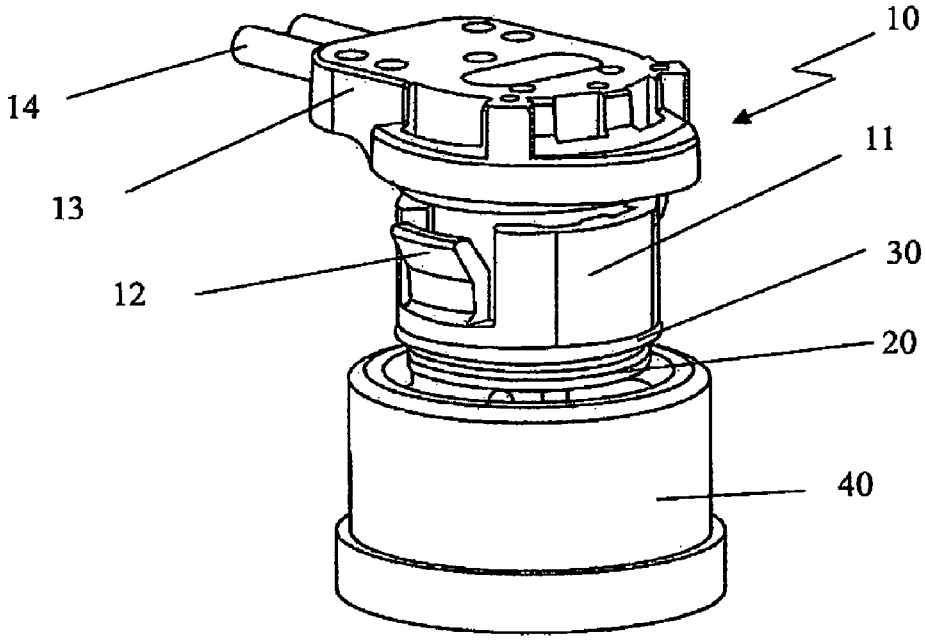
FIG. 1 is a perspective three-dimensional view of one connector according to the present invention.

FIG. 1 is a perspective three-dimensional view of a SRS connector system according to the present invention. It comprises a sealable squib connector 10 and a counter connector 40. The connector is provided with a plug-in projection 11, a seal expansion element 20 and a sealing ring 30. The sealing ring 30 is may be an O-ring seal. It may be an elastomer made from synthetic rubber. In one aspect, the connector housing is provided with a base part for the reception of connector cables and the plug-in projection extends perpendicular from the base part of the housing.

Due to the expansion of the sealing ring it is possible to establish a reliable sealing when the plug-in projection is inserted in a mating connector receptacle. In this case the sealing ring will be dimensioned such that it will be firmly and sealingly pressed against the inner walls of the mating receptacle.

As was mentioned above, the sealable squib connector according to the present invention is preferably part of the electrical circuitry of an SRS ignition system, for example of a passenger vehicle. The sealing ring preferably enables a water-proof connection between the connector and a mated connector in its expanded condition, when the squib connector is locked with its counter connector.

The plug-in projection 11 can be inserted into the counter connector 40, which is shown in the figures in a form of a squib receptacle 40. In the embodiment shown, the connector 10 is further provided with a base part 13 for the reception of connector cables 14. The base part 13 has a generally rectangular shape and the plug-in projection 11 extends perpendicular from the same. Further, the plug-in projection 11 is provided with latching arms 12 on opposite sides thereof to provide for a mechanical fastening of the connector 10 with the receptacle 40.

FIG. 2 shows the connector of FIG. 1 in a partially cut view. As can be seen from the figure, the receptacle 40 is provided with two contact pins 41 and the plug-in projection of connector 10 is provided with two corresponding contact sleeves 19, to establish an electrical connection between connector 10 and pins 41. Further, the receptacle 40 is provided with a latching groove 42 which may act together with the latching arms 12 of the plug-in projection to mechanically couple connector 10 and counter connector. Further, it can be seen from FIG. 2 that the expansion element 20 is provided with openings 21 through which the contact pins 41 can pass. The plug-in projection 11 is provided with a mating face 16 at its distal end. The mating face 16 is generally perpendicular to the mating direction. Further, it is provided with an opening 15 for the insertion of the contact pins 41 and with openings 17 (see FIG. 3) to receive guiding beams 25 provided on the expansion element. The sealing ring 30 rests on a sloped surface of the expansion element 20 and is not yet expanded, such that the connector 10 can easily be inserted into the receptacle 40 without having to overcome any frictional forces between sealing ring and inner side walls of the receptacle.

FIG. 3 shows the arrangement of FIG. 2, when the connector 10 is further pushed into the receptacle 40. In the condition shown in FIG. 3 the expansion element 20 rests on the bottom of the receptacle, however it is still in its first position and the sealing ring is not yet expanded.

In the following, the expansion element 20 will be described in more detail under reference of the enlarged view of FIG. 3. The element 20 comprises a generally cylindrical portion 22 having an outer diameter which is larger than the inner diameter of the ring 30. Above the cylindrical portion 22 a portion in the shape of a truncated cone 23 is provided. As can be seen from the enlarged view, the smallest diameter of the truncated cone 23 is smaller than the inner diameter of ring 30 and its largest diameter is larger than the inner diameter of the ring 30 (and has at the same time the same diameter as portion 22). Thus, when the expansion element 20 and the mating face 16 of the plug-in projection 11 are moved relative towards each other, the truncated cone portion 23 moves into and through the opening of the ring pressing the ring radially outward, thereby expanding the same. In the embodiment shown, the expansion of the ring is stopped by the inner sidewalls of the receptacle, so that the ring 30 is firmly pressed between the inner wall of the receptacle and a surface of the mating face 16 and the expansion element. In this way a very reliable seal is provided, which protects the electrical connection from moisture and dust.

FIG. 4 shows the connector 10 in its end position, and the expansion element in its so called second position. As can best be seen from the enlarged view of FIG. 4, the connector 10 and its parts are dimensioned such that the expansion element 20 abuts the mating face of the plug-in projection and the sealing ring 30 is firmly pressed against the inner sidewall of the receptacle. Further, the cylindrical portion 22 of the expansion element is arranged in the interior of the sealing ring, i.e. inside of the opening defined by the ring. Since the outer diameter of the cylindrical portion 22 is larger than the inner diameter of the unexpanded ring, the ring 30 is radial pressed outwards by the expansion element. Without the inner walls of the receptacle, the sealing ring would be expanded even further, i.e. the outer diameter of the sealing ring would be enlarged. However, due to the rigid structure of the receptacle 40, the expansion of the ring is stopped and the ring is deformed and firmly pressed against the walls of receptacle, mating surface 16 and expansion element, thereby providing a reliable and secure sealing.

The shape of the expansion element 30 is only exemplarily. It should be clear, that the expansion element could be provided with a shape of a truncated cone only, without the cylindrical portion 22. On the other hand, the truncated cone 23 is not absolutely necessary, since the cylindrical portion 22 is sufficient for the expansion effect. However, the above described shape, in which the essentially cylindrical portion of the seal expansion element merges in a portion in the shape of a truncated cone, is a particularly advantageous embodiment, since it facilitates the insertion or movement of the expansion element into the interior, i.e. opening, of the sealing ring.

FIGS. 5 to 8 show the same connector arrangement as FIGS. 1 to 4 in a cross sectional view. Therefore, like elements are denoted with the same reference number and not explained further in any detail. FIG. 5 shows connector 10 halfway inserted into receptacle 40. The sealing ring 30 is not expanded and does only slightly contact the inner walls of receptacle 30, thus almost no frictional force has to be overcome when inserting connector 10 in receptacle 40. It can be seen that connector 10 and its elements are formed such that the sealing ring can establish an effective sealing against the inner walls of the receptacle 40 when it is expanded. The expansion element 20 is shown in its first position. In FIG. 6, expansion element 20 is still in its first position and rests on the bottom of receptacle 40. Connector 10 is not yet fully locked. The expansion element 20 has two guiding beams 25 extending along the axis of mating direction through openings in the mating face 16 into the plug-in projection to guide the movement of the seal expansion element. The guiding beams 25 are provided with stop members 26 (see FIG. 6) engaging a stop face provided on the plug-in projection to prevent an unintentional loss of the seal expansion element. As can be seen from FIG. 6, the inner diameter $D_1$ of the unexpanded sealing ring 30 is slightly smaller than the outer diameter $D_2$ of the cylindrical portion 22 respectively the largest diameter of the truncated cone portion 23. Further, the outer diameter $D_3$ of the unexpanded sealing ring is slightly smaller than the inner diameter $D_4$ of receptacle 40.

In FIG. 7, the connector 10 is pushed even further into the receptacle, thereby pushing the sealing ring 30 along the truncated cone portion 23 over the cylindrical portion 22 of the expansion element 20 to some extend. In this way, the sealing ring 30 is expanded slightly and pushed outwardly, as indicated by the horizontal arrows in the sealing ring 30. The expansion element 20 is now in a position between the first and the second position and the sealing is not yet fully established.

In FIG. 8, connector 10 is fully inserted in receptacle 40 and the latching arms 12 are latched in the respective latching groove 42. Expansion element 20 is in its second position and its portion with the larger diameter than the inner diameter of the sealing ring (in its unexpanded condition) is arranged in the interior of the sealing ring, thereby expanding the sealing ring. Due to the inner walls of the receptacle 30, the expansion of the sealing ring is stopped by said walls, so that the sealing ring is firmly pressed against its surrounding surfaces.

It should be noted, that usually the receptacle 40 is provided by a different manufacturer than the connector 10. The receptacle 40 is usually standardized and the manufacturer of the connector 10 has no influence on the shape and form of the same. Therefore, the provision of a reliable seal between connector and receptacle is particularly difficult, since the manufacturer of connector 10 has very limited design alternatives since he has to consider the given shape of the receptacle 40. With the present invention, a very reliable sealing is provided which may be applied with a number of different counter connectors, i.e. connector receptacles, by simply choosing an appropriate size for sealing ring and expansion element. Further, since the seal is provided inside of the receptacle it is surrounded on all sides by material, such that it is securely protected from outside influences, like for example mechanical damages. The scaling surfaces and the sealing act partly in the horizontal plane in the figures, i.e. perpendicular to the mating direction of the connectors. Since during the insertion of the connector 10 into the receptacle 40 the sealing ring 30 does not or only slightly contact the inner side walls of the receptacle, the mating of the connectors is not impaired by high frictional forces between sealing member and receptacle walls.

In order to ensure the sealing between the ring 30 and the top connector 10 a minimum axial sealing pressure is required.

To this end, in a preferred embodiment, in the closed position of the seal expansion element 20 tip 27' of a flexible arm 27 is clinched under a complementary part (not shown) of the cover top connector 10, such a way the sealing pressure is transmitted from the expansion element 20 to the connector 10 through the tip 27', such a way the latching arm 12 remains without axial tension.

Alternatively, the sealing pressure is transmitted through the latching arm 12 to the latching groove 42 of receptacle 40 and back to the expansion element 20.

In an alternative solution, as can be seen in FIG. 4', the receptacle element can have a cavity for receiving the sealing ring 30, this cavity having the shape of the former expansion element 20.

The invention claimed is:

1. Sealable squib connector system comprising a connector housing comprising a plug-in projection, which plug-in projection has a mating face at its distal end; a counter connector for receiving the plug-in projection; a resilient sealing ring having an inner diameter; and a seal expansion element, where the seal expansion element and the mating face are able to move towards each other such that the seal expansion element expands the inner diameter of the sealing ring when the plug-in projection is mated in the counter connector.

2. Sealable squib connector system according to claim 1, wherein the sealing ring is arranged around the seal expansion element.

3. Sealable squib connector system comprising a connector housing comprising a plug-in projection, which plug-in projection has a mating face at its distal end; a counter connector for receiving the plug-in projection; a resilient sealing ring and a seal expansion element that expands the diameter of the sealing ring when the plug-in projection is mated in the counter connector, wherein the seal expansion element comprises a portion having a diameter larger than the inner diameter of the unexpanded sealing ring, which portion is positioned outside the interior of the sealing ring in the first position of the seal expansion element and which portion is arranged in the interior of the sealing ring in the second position, thereby expanding the sealing ring.

4. Sealable squib connector system according to claim 1, wherein the seal expansion element comprises an essentially cylindrical portion having a diameter (D2) larger than the inner diameter (D1) of the unexpanded sealing ring, which cylindrical portion is positioned outside the interior of the sealing ring in the first position of the seal expansion element and which cylindrical portion is arranged in the interior of the sealing ring in the second position, thereby expanding the sealing ring.

5. Sealable squib connector system according to claim 1, wherein the essentially cylindrical portion of the seal expansion element has a portion in the shape of a truncated cone, wherein the smallest diameter of the truncated cone is smaller than the inner diameter of the sealing ring and the largest diameter (D2) of the truncated cone is larger than the inner diameter (D1) of the unexpanded sealing ring, whereby the sealing ring is expanded by means of said truncated surface when the plug-in projection is mated in the counter connector.

6. Sealable squib connector system according to claim 1 comprising a SRS ignition system sealable squib connector which comprises the connector housing and contact sleeves in the connector housing.

7. Sealable squib connector comprising a connector housing comprising a plug-in projection, which plug-in projection is configured to be mated in a counter connector and has a mating face at its distal end; a resilient sealing ring having an inner diameter; and a seal expansion element, where the seal expansion element and the mating face are moveable relative towards each other such that the seal expansion element expands the inner diameter of the sealing ring when the plug-in projection is mated in the counter connector.

8. Sealable squib connector according to claim 7, wherein seal expansion element is movable in the mating direction from a first position to a second position thereby expanding the sealing ring.

9. Sealable squib connector according to claim 8, wherein the seal expansion element is movably mounted on the plug-in projection, such that it can be moved along the axis of mating direction relative to the mating face of the plug-in projection.

10. Sealable squib connector comprising a connector housing including a plug-in projection, which plug-in projection is intended to be mated in a counter connector and has a mating face at its distal end; a resilient sealing ring; and a seal expansion element that expands the sealing ring when the plug-in projection is mated in the counter connector, wherein the seal expansion element has at least one guiding beam extending along an axis of mating direction of the connector through an aperture in the mating face into the plug-in projection to guide movement of the seal expansion element.

11. Sealable squib connector according to claim 10, wherein the at least one guiding beam is provided with at least one stop member engaging a stop face provided on the plug in-projection to prevent an unintentional loss of the seal expansion element.

12. Sealable squib connector according to claim 7 where the connector is a SRS ignition system sealable squib connector.

* * * * *